US006877899B1

(12) United States Patent
Cannon, Sr.

(10) Patent No.: US 6,877,899 B1
(45) Date of Patent: Apr. 12, 2005

(54) COUPON BAG WITH DETACHABLE PORTION AND METHODS OF MAKING SAME

(75) Inventor: Frank Cannon, Sr., Westerville, OH (US)

(73) Assignee: Pine Creek LLC, Westerville, OH (US)

( * ) Notice: Subject to any disclaimer, the term of this patent is extended or adjusted under 35 U.S.C. 154(b) by 0 days.

(21) Appl. No.: 10/265,806

(22) Filed: Dec. 9, 2002

(51) Int. Cl.[7] ..... B65D 30/00
(52) U.S. Cl. ..... 383/127; 383/9; 229/70
(58) Field of Search ..... 383/127, 38, 37, 383/207, 209, 77, 9, 67; 229/70

(56) References Cited

U.S. PATENT DOCUMENTS 3,204,855 A * 9/1965 Boynton et al. ..... 215/11.3
3,356,286 A * 12/1967 Greason ..... 229/70
3,804,323 A 4/1974 Bemel
4,630,311 A * 12/1986 Bentson ..... 383/37
4,759,494 A * 7/1988 Smyth ..... 229/70
4,932,791 A * 6/1990 Vetter ..... 383/93
5,011,466 A 4/1991 DeMatteis et al.
5,035,515 A * 7/1991 Crossman et al. ..... 383/38
5,298,104 A 3/1994 Absher
5,385,251 A * 1/1995 Dunn ..... 215/11.3
5,407,419 A * 4/1995 Kelly et al. ..... 602/3
5,682,730 A * 11/1997 Dobreski ..... 53/469
6,068,584 A 5/2000 Daniels et al.
6,206,570 B1 3/2001 Cortopassi
6,234,673 B1 * 5/2001 Tonoff ..... 383/9

FOREIGN PATENT DOCUMENTS

GB 1034170 * 6/1966 ..... 229/70

* cited by examiner

*Primary Examiner*—Jes F. Pascua
(74) *Attorney, Agent, or Firm*—Roger A. Gilcrest

(57) ABSTRACT

A plastic bag with a removable coupon section and a method for forming plastic bags with removable coupon sections is presented. The bag comprises a bag portion and a coupon portion. The coupon portion comprises two flaps. Each flap representing at least one coupon. The coupons are separable from the bag portion due to perforations. Where multiple coupons are contianed on the same flap, the coupons may be seperated from one another due to perforations. The flaps are either not joined to one another due to notching of the plastic film from which they are formed or are separable due to welded perforations. This enables the coupons the be individually removed without disturbing other coupons. In the method for making the plastic bags with a removable coupon section, a roll of plastic film is folded over onto itself and welded together. The initial weld forms the bottom of the bag portion. The coupon portion may be perforated to assist in the separation of the coupon from the bag portion.

6 Claims, 6 Drawing Sheets

COUPON BAG WITH DETACHABLE PORTION AND METHODS OF MAKING SAME

TECHNICAL FIELD OF THE INVENTION

This invention relates to flexible bags and more particularly to bags having removable coupons affixed thereto and a method for the manufacturing thereof.

BACKGROUND OF THE INVENTION

It has long been the desire of manufacturers, suppliers, retailers, and other sellers of products, goods, and services to efficiently reach consumers with promotional advertising in the form of coupons. Sellers often place coupons in newspapers or magazines to attract customers. However, because many persons in a certain market area do not subscribe to newspapers or magazines containing such coupons, the seller is incapable of reaching those persons. Also, newspapers and magazines are often saturated with ads and coupons. Consequently, such ads may fail to get noticed.

Sellers have recognized that advertisers frequently reach potential consumers by placing packets of advertisements at the potential consumer's home. Typically, the packets consist of a plastic bag filled with advertising. Advertisers, being cost conscious, have been placing advertisements on the bag and have even begun to attach coupons to the bag itself. However, prior approaches for applying a coupon to a plastic bag have been deficient; for example, the coupons may not have been easily removable, may not have been attractive to the consumer, or may have damaged the structure of the bag when removed. In addition, prior approaches have been deficient or lacking in applying multiple coupons to a single bag that are easily seperable from one another and the bag.

U.S. Pat. No. 6,206,570 to Cortopassi discloses a flexible container that has a removable section on which coupons or other marketing information may be printed. The removable section may be separated from the bag container without compromising the container's integral barrier wall.

U.S. Pat. No. 6,068,584 to Daniels et al. discloses a plastic bag having a promotional strip. The promotional strip is connected to the bag at the top edge and the bottom edge of the bag. The promotional strip may be disposed either between the folded bag edges forming gussets or outside of the gussets. Further, the promotional strip may or may not be perforated.

U.S. Pat. No. 5,298,104 to Absher discloses a flexible bag with a removable coupon. The removable coupon can be peeled from the surface of the bag. In this invention, the coupon is essentially a sticker placed on the bag.

U.S. Pat. No. 5,011,466 to DeMatteis et al. discloses a T-shirt type grocery bag having a tear-off coupon provided during manufacture. The coupon is formed in the area typically removed for the formation of the handle portion of the bag.

U.S. Pat. No. 3,804,323 to Bemel discloses a shopping bag with a detachable coupon portion. The coupon portion is either a perforated tear-away portion along one side of the mouth of the shopping bag or is a tear-away pocket on the outside bottom of the bag.

Consumers may be unwilling to go to the trouble of tearing off coupons from bags perhaps because of the unattractiveness of the coupons placed upon the bags which the prior art has provided or because of the difficulty in removing the coupon from bag. In addition, the plastic material of some bags may be unsuitable for use as a coupon from the consumer's perspective. Accordingly, there is a need for an inexpensive and efficient way to provide bags having high quality coupons attached thereto which are attractive to the consumer and easily removeable such that the consumer will wish to make use of the coupon.

Consequently, it is a primary objective of the invention to provide an inexpensive and efficeint way to manufacture bags having high quality coupons such that the coupons are attractive to the consumer yet are easily removeable.

Further, it is also an objective of the present invention to provide an inexpensive and efficient way to manufacture bags having multiple high quality coupons such that the coupons are attractive to the consumer, easily removeable from the bag and easily seperable.

It is also an object of the present invention to provide the bag manufacturer with the ability to include multiple coupons that are easily seperated from one another.

It will be appreciated that similar advantages may obtain in other applications of the present invention. Such advantages may become apparent from the present disclosure or through practice of the present invention.

SUMMARY OF THE INVENTION

This invention relates to flexible bags and more particularly to bags having removable coupons affixed thereto and a method for the manufacturing thereof.

Bags

A bag for distributing coupons of the present invention comprises a bag portion and a coupon portion. The bag portion comprises a front panel having sides and a bottom and a rear panel having sides and a bottom. The front panel is joined to the rear panel at the sides and at the bottom so as to define a bag. The coupon portion comprises a front coupon strip having sides and a rear coupon strip having sides. The front coupon strip is removably attached to the front panel of the bag portion and the rear coupon strip is removably attached to the rear panel of the bag portion.

The front coupon strip and the rear coupon strip are either not connected or are partially connected by a heat weld applied over a perforation. For the situation where the front coupon strip and the rear coupon strip are not connected, a notch may have been formed in the coupon portion of the plastic sheets such that the subsequently applied heat weld will not be able to join any plastic material together. Thus, the front coupon strip and the rear coupon strip are independent of one another. For a partially connected coupon portion, a vertical perforation is placed in the exact position as the heat weld will subsequently be placed. Thus, the front coupon strip may be easily separated from the rear coupon strip due to the perforation.

It is preferred that the bag portion further comprise a hole through said front panel and through said rear panel so as to permit said bag to be hung from an object. The hole permits the bag to be hung from hooks, doorknobs, door handles and other projections. Preferably, the front coupon strip contains at least two coupons; each coupon separable from each other coupon. It is most preferred that perforations are used to ease in the separation of the coupons from one another. It is also preferred that the rear coupon strip contains at least two coupons, each coupon separable from each other coupon. It is most preferred that perforations are used to ease in the separation of the coupons from one another.

Additionally, it is preferred that that front coupon strip further comprises perforations to assist in separating the front coupon strip from the bag portion of the bag. It is also preferred that the rear coupon strip further comprises perforations to assist in separating the rear coupon strip from the bag portion of the bag.

Fabricating

In a preferred method for forming a plastic bag that has detachable coupons a roll of plastic film is center-folded such that the edges of the roll are aligned with one another. The center-folded film is then cut along the fold by a razor knife or other suitable cutting device. The cutting operation transforms the center folded sheet into two sheets of plastic by forming a second edge. The two sheets of plastic are held in alignment by the bag making machinery.

Next, horizontal perforations are formed simultaneously through both sheets of plastic. Horizontal perforations are perforations that are substantially parallel to the feed direction of the plastic film. One horizontal perforation assists in separating the coupon portion from the bag portion and is referred to as the major horizontal perforation. Additional horizontal perforations may assist in further subdividing the coupon portion into multiple individual coupons. Any suitable means maybe used to form the horizontal perforations.

The two horizontally perforated plastic sheets are then passed to yet another perforation process. In the second perforation process, the two horizontally perforated plastic sheets are perforated vertically. A vertical perforation is a perforation that is perpendicular to horizontal perforations. The vertical perforations assist in defining and separating the individual coupons in the coupon portion of the bag. The vertical perforations may also be used, in conjunction with a heat weld, to separate the front coupon strip from the rear coupon strip. The vertical perforations are typically formed by an air-operated punch. However, any suitable perforation means may be used for forming the vertical perforations.

An optional step employed where it is desired to have front and rear coupon strips that are not connected to one another at their sides is to form a notch in the coupon portion of the bag. The notch is positioned where a heat welding operation will separate the bags. The notch removes the material that the heat weld would bond together, thereby leaving the front and rear coupon strips unattached at their respective sides. The notch generally extends from the bottom edge of the coupon portion towards the horizontal perforation that separates the bag portion from the coupon portion. The notch may be formed by an air-operated punch having a cutting die adapted to the specific shape of the notch.

The two sheets of perforated plastic film are then heat-welded together by forming a continuous heat weld parallel to the aligned edges of the two perforated plastic sheets. The continuous heat-weld is generally parallel to the major horizontal perforation. The continuous heat-weld is adjacent to the major horizontal perforation. The continuous heat-weld defines the bottom of the bag portion.

A second heat welding operation forms sides to the bags by creating a heat weld that extends perpendicularly across the perforated and heat-welded plastic sheets. The second heat welding operation is aligned with a vertical perforation or with the notch depending upon the style of bag desired. The second heat welding operation forms sides in the bag portion of the bag. If vertical perforations were positioned in the coupon portion of the bag, the second heat-welding operation partially connects the front coupon strip to the rear coupon strip. If, instead of the vertical perforations, a notch was formed in the coupon portion the second heat welding operation only welds together material in the bag portion, thereby leaving the front coupon strip unattached to the rear coupon strip at their respective sides.

It is preferred that the method additionally comprises the step of forming a hole in the bag portion. A roll die, air-punch or other conventional manufacturing means may form the hole.

This list is by no means exhaustive, and in fact is limited by the considerations of the interests of bag manufacturers today with currently available technology. It is anticipated that this bag design and method will lead to new applications, new knowledge bases, and entirely new methods of fabrication.

DETAILED DESCRIPTION OF THE PREFERRED EMBODIMENT(S)

In accordance with the foregoing summary, the following presents a detailed description of the preferred embodiment of the invention that is currently considered to be the best mode.

Bags

Figure 1:
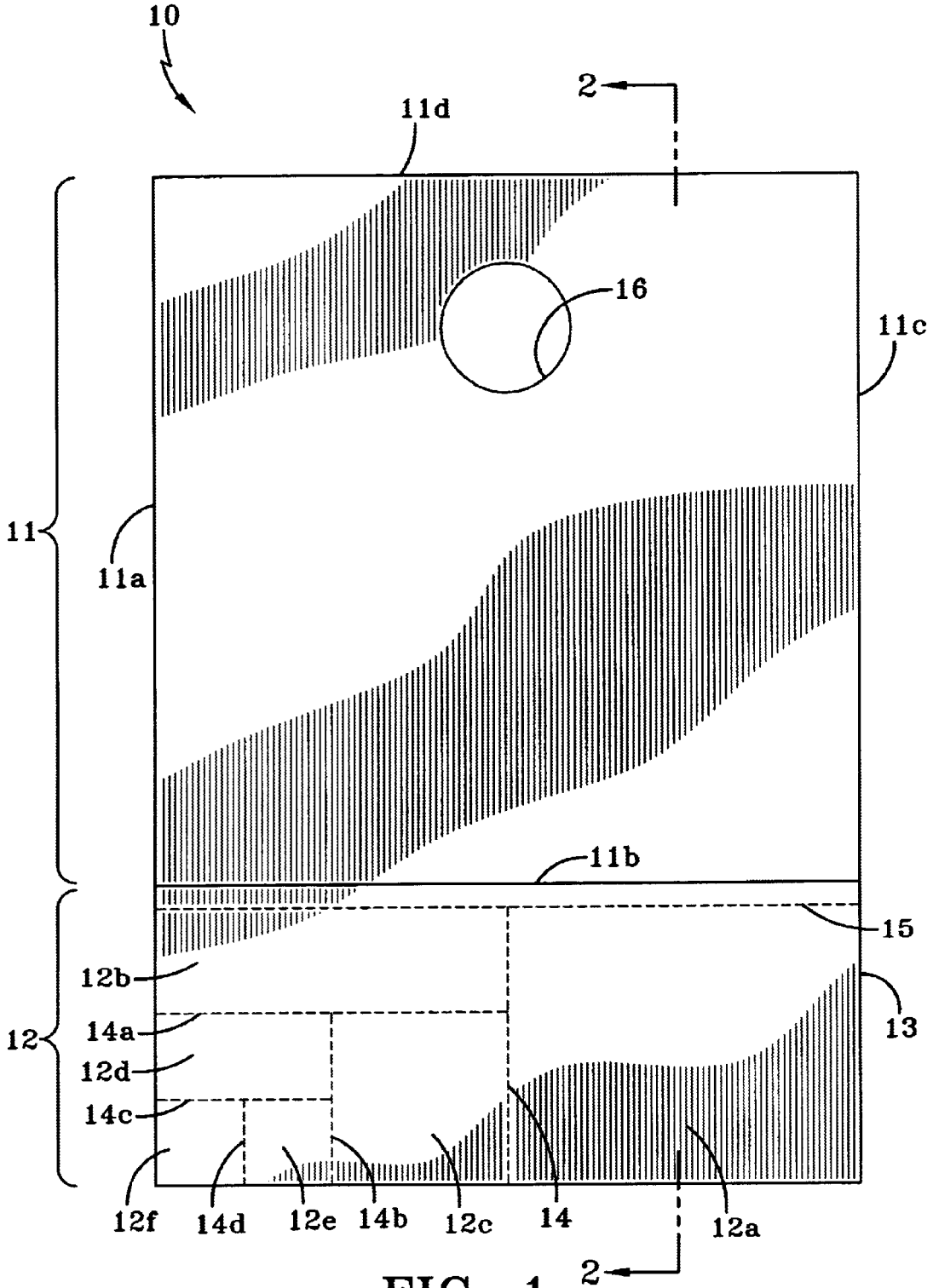
FIG. 1 is a view of a coupon bag in accordance with one embodiment of the present invention.

Turning to FIG. 1, a preferred coupon bag 10 of the present invention is presented. The coupon bag 10 comprises a bag portion 11 and a coupon portion 12. The bag portion comprises two sides 11*a*, 11*c*, a bottom 11*b* and a top 11*d*. The sides 11*a*, 11*c* are formed by welding two plastic sheets together. The bottom 11*b* of the bag portion is also formed by a welding operation. The coupon portion 12 can be easily removed from the bag portion due to perforation 15. The coupon portion 12 comprises two leafs (shown in FIG. 2). The leafs are only partially welded together at the sides due to a perforation 13.

In the embodiment shown in FIG. 1, each leaf of coupon portion 12 is further divided into six coupons 12*a*, 12*b*, 12*c*, 12*d*, 12*e* and 12*f* by perforations 14, 14*a*, 14*b*, 14*c*, and 14*d*. The coupon portion 12 may be subdivided into multiple coupons by additional perforations. Additionally illustrated is hole 16 which may be used to hang the bag 10 from a doorknob, door handle or other appropriate structure.

Figure 2:
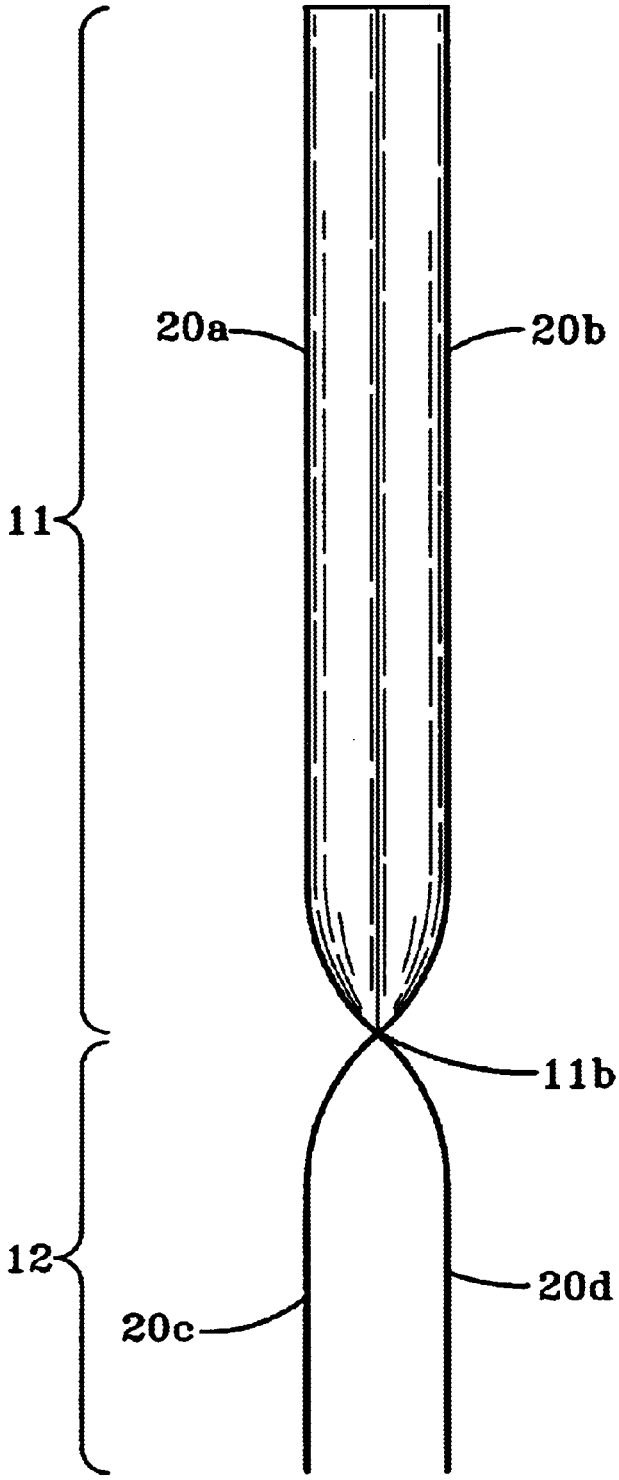
FIG. 2 is a side view of the coupon bag in accordance with one embodiment of the present invention illustrating the heat weld that forms the bottom of the bag portion.

FIG. 2 is a cross sectional view of the embodiment shown in FIG. 1. The cross sectional view shows the bag portion 11 and the coupon portion 12. The bag portion 11 comprises a first plastic sheet 20*a* and a second plastic sheet 20*b*. The coupon portion comprises a first leaf 20*c* and a second leaf 20*d*. The bag portion 11 is separated from the coupon portion by the heat weld 11*b*.

Fabricating

A preferred method for forming bags of the present invention is illustrated in FIGS. 3 through 8.

Figure 3:
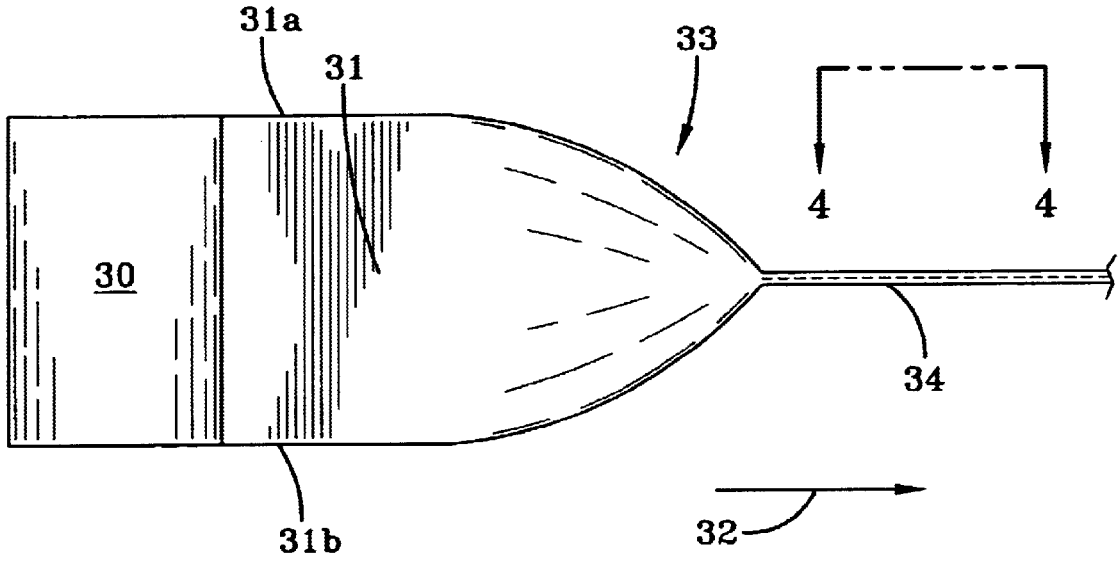
FIG. 3 illustrates a plastic sheet centerfold alignment step of a method of the present invention.

FIG. 3 is a side view of the first step in forming bags of the present invention. A single wound roll of plastic film 30 supplies a feed of plastic film 31. The plastic film feed 31 flows in direction 32. The plastic film 31 is center-folded 33 to form a folded feed 34. While center folding, the edges 31*a*, 31*b* of the plastic film 31 are aligned one another in much the same way as one would fold a sheet of paper in half.

Figure 4:
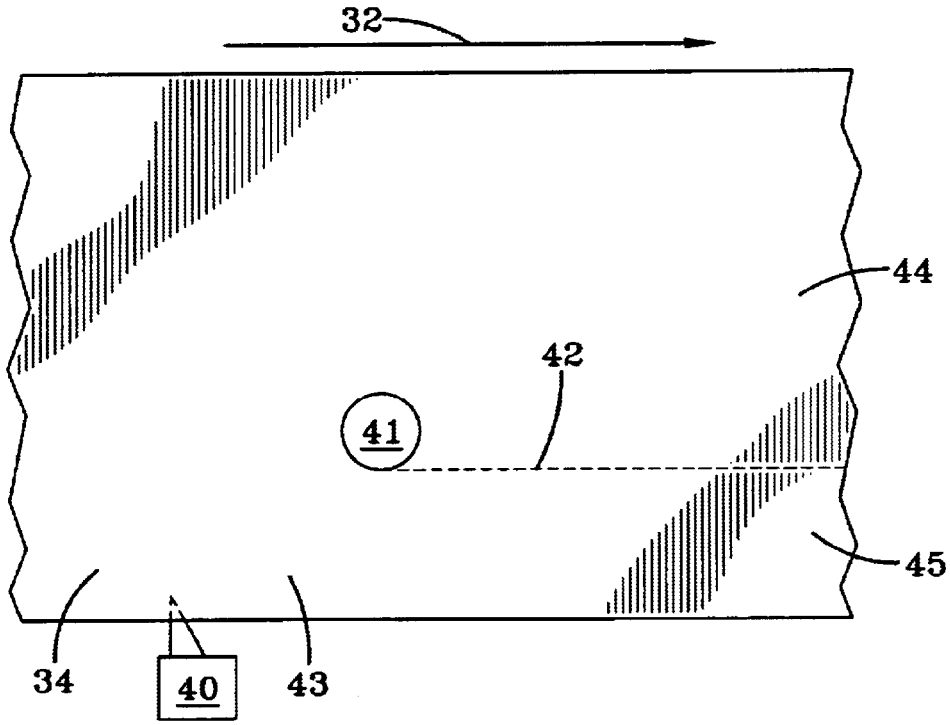
FIG. 4 illustrates continuous cutting and perforation operations in accordance with one method of the present invention.

FIG. 4 is a top view of the folded feed 34 as it is cut along the fold and perforated. The folded feed 34 is cut by razor knife 40 along the fold to create a feed 43 of two plastic sheets. Perforating means 41 perforates the feed. The perforation shown is the major horizontal perforation 42. Additional horizontal perforations may be placed in the feed 43 at this time should it be desired to have multiple coupons as shown in FIG. 1. The major horizontal perforation 42 makes it easier to separate the coupon portion from the bag portion. The major horizontal perforation 42 divides the feed 43 into an upper portion 44 and a lower portion 45. The upper portion 44 will eventually become a bag portion and the lower portion 45 will eventually become a coupon portion.

Figure 5:
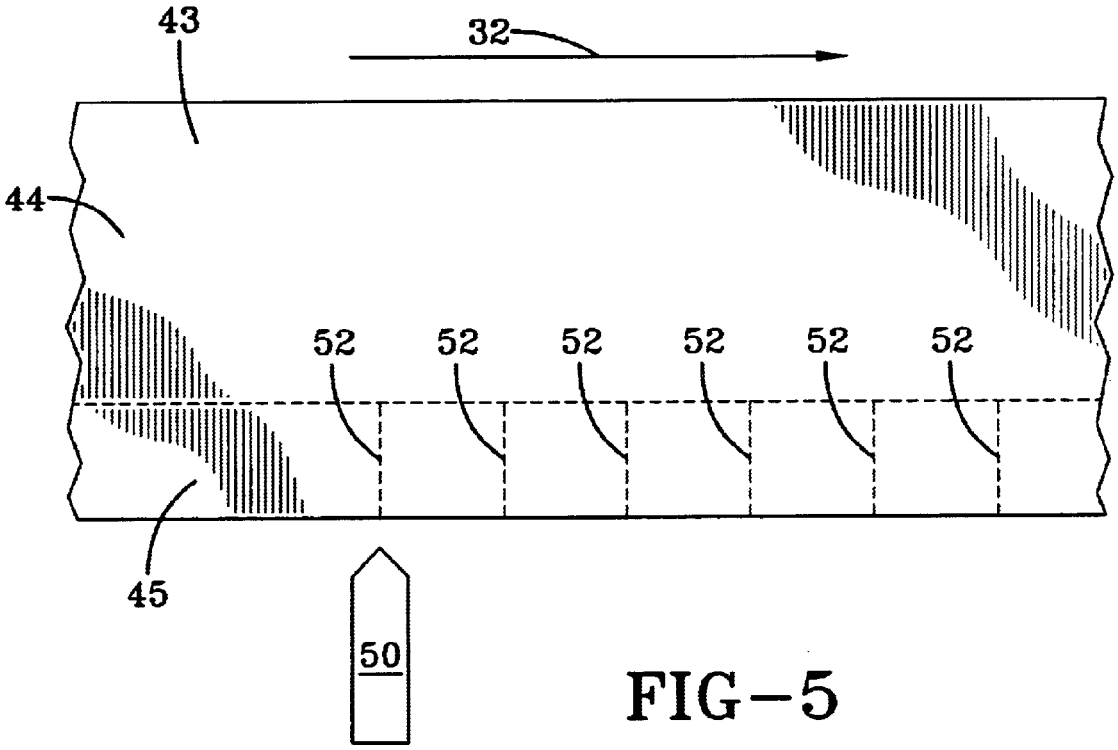
FIG. 5 illustrates a perforation step in accordance with one method of the present invention.

FIG. 5 is a top view of the feed 43 as it is vertically perforated by air-operated perforating die 50. The vertical perforations 52 may be placed to divide the coupon portion 45 into multiple coupons as illustrated in FIG. 1. Additionally, vertical perforations 52 may be aligned with the heat weld that forms the sides of the bag portion. If vertical perforations are aligned with the heat-weld operation, the front coupon strip and the rear coupon strip will be joined at their respective sides by a perforated weld that can be torn apart to separate the front coupon strip from the rear coupon strip.

Figure 5A:
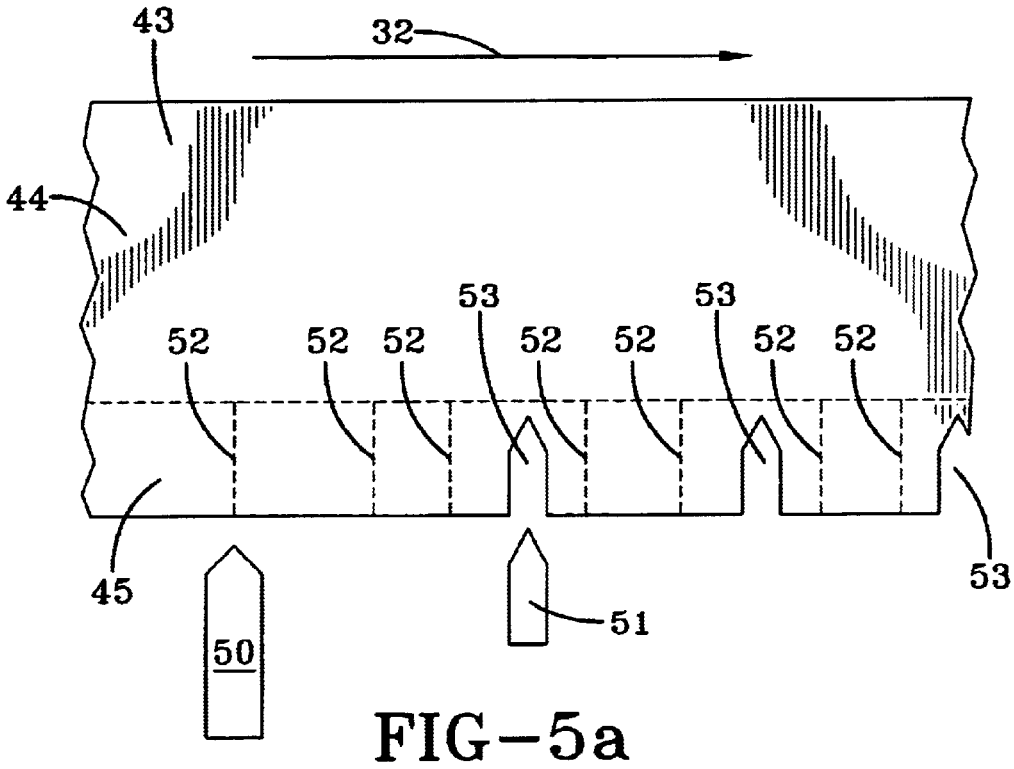
FIG. 5*a* illustrates an optional notching step in accordance with one embodiment of the present invention.

Alternatively, FIG. 5*a* shows a notching operation that may be used in place of the vertical perforations to separate the front and rear coupon strips. The notch 53 may be formed by an air-operated punch 51 adapted to remove a portion of the plastic material. The notch 53 is aligned with the position of the heat weld that forms the side welds of the upper portion 44. The notch 53 is placed in the lower portion 45 so as not to disrupt the continuity of the continuous heat weld shown in FIG. 6. While vertical perforations 52 may still be employed to divide the lower portion 45 into multiple coupons, a notching operation ensures that the coupons are not attached to one another by the subsequent heat-welding operation because the notching operation removes the material that the heat-welding operation requires.

Figure 6:
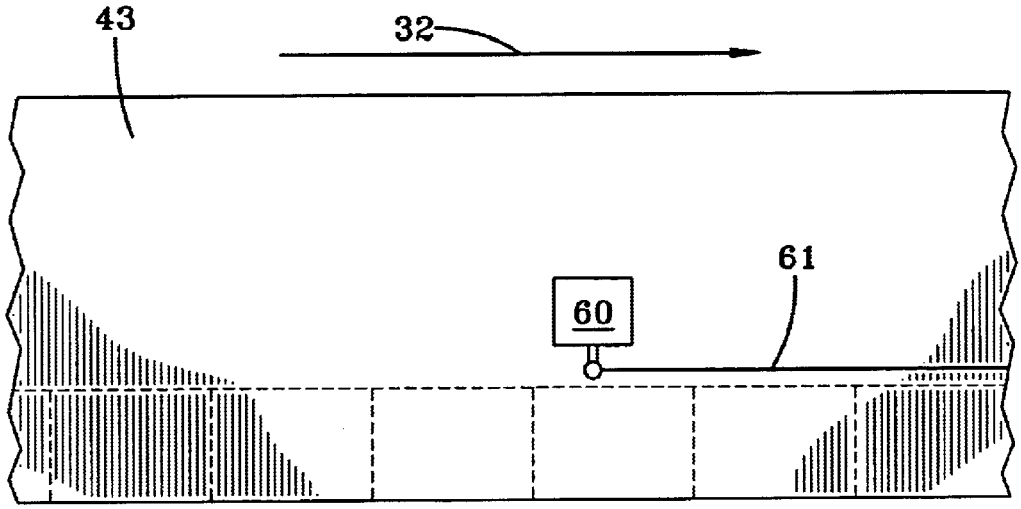
FIG. 6 illustrates a continuous heat-welding step in accordance with one method of the present invention.

FIG. 6 is a top view of the feed 43, as it is heat welded together by continuous heat welding unit 60. Heat welding unit 60 welds the two layers of plastic film together as represented by weld 61. The continuous heat weld 61 forms the bottom of the bag portion. The heat weld 61 further divides the plastic feed into an upper portion and a lower portion. The upper portion will eventually become a bag portion and the lower portion will eventually become a coupon portion.

Figure 7:
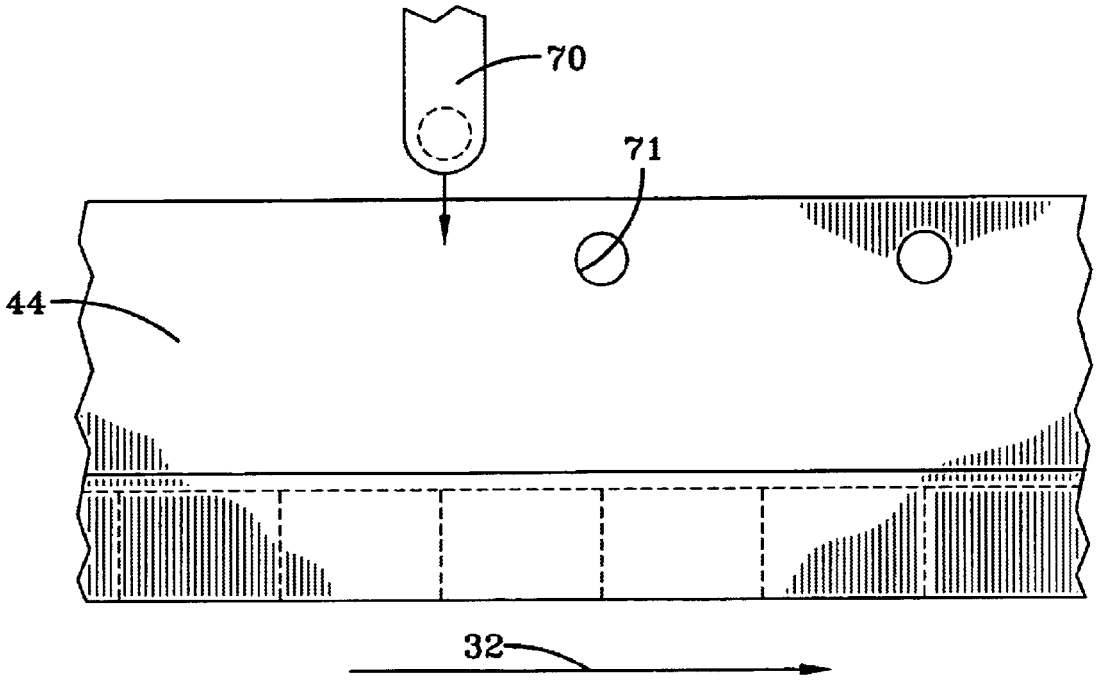
FIG. 7 illustrates an optional hole-punching step in accordance with one method of the present invention.

FIG. 7 shows an optional hole punching operation. A hole-punch 70 forms a hole 71 in the upper portion 44 of feed 43. The hole 71 extends through both layers of the plastic film of feed 43.

Figure 8:
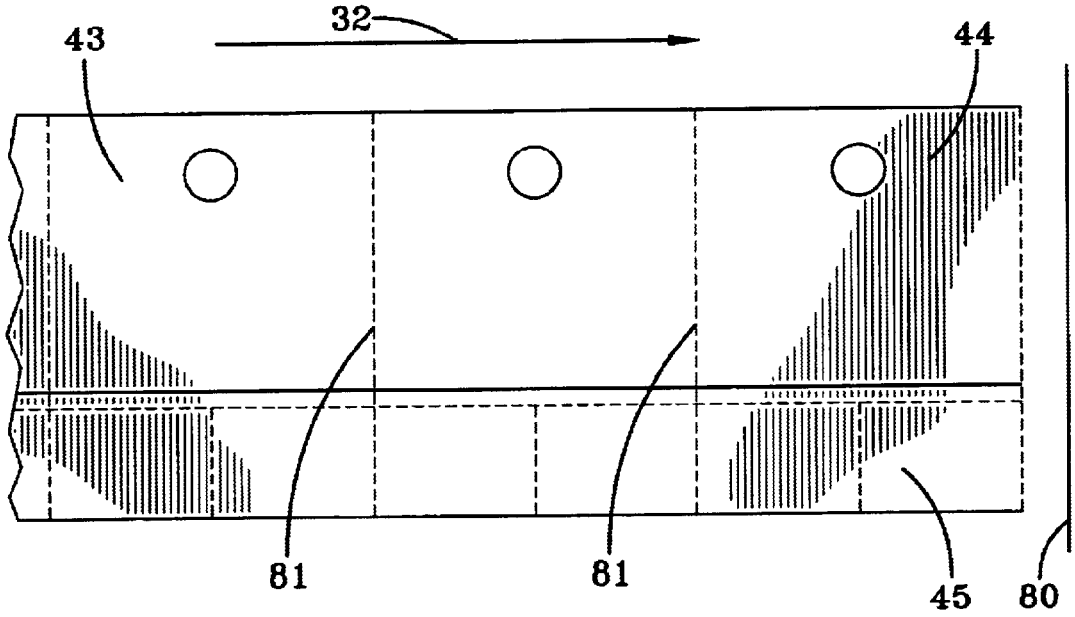
FIG. 8 illustrates a heat-welding step in accordance with one method of the present invention.

FIG. 8 is a top view of the final heat welding operation. The feed 43 is separated into individual bags by heat-welding unit 80. The heat welding unit 80 contacts the common feed at in weld zone 81. The heat-welding unit 80 welds the two sheets of plastic film in the upper portion 44 together, while either partially welding the two sheets of plastic film in the lower portion 45 or where a notching operation has been used, leaving the plastic sheets un-welded. The weld created by the heat-welding unit 80 defines the side welds of the bag portion of the bag (see FIG. 1). The heat-welding unit 80 also separates the newly formed bag from the common feed 43 due to excessive heat applied by the heat-welding unit 80 that effectively cuts through the feed 43 as it welds them together.

While the invention has been described in connection with what is presently considered to be the most practical and preferred embodiments, it is to understood that the invention is not limited to the disclosed embodiment, but on the contrary, is intended to cover various modifications and equivalent arrangements included within the spirit and scope of the appended claims, which are incorporated herein by reference.

What is claimed is:

1. A bag for distributing coupons, said bag comprising:

(a) a bag portion, said bag portion comprising a front panel having sides and a bottom and a rear panel having sides and a bottom, said front panel joined to said rear panel at said sides and at said bottom so as to define a bag; and (b) a coupon portion, said coupon portion comprising a front coupon strip having sides and a rear coupon strip having sides, said front coupon strip removably attached to said front panel of said bag portion, said rear coupon strip removably attached to said rear panel of said bag, wherein said front coupon strip's sides are partially connected to said rear coupon strip's sides by perforated heat welds, said perforated heat welds adapted to permit said front coupon strip to be separated from said rear coupon strip.

2. The bag of claim 1 wherein said bag portion further comprises a hole through said front panel and through said rear panel so as to permit said bag to be hung from an object.

3. The bag of claim 1 wherein said front coupon strip contains at least two coupons, each said coupon separable from each other coupon by perforations.

4. The bag of claim 1 wherein said rear coupon strip contains at least two coupons, each said coupon separable from each other coupon by perforations.

5. The bag of claim 1 wherein said front coupon strip further comprises perforations to assist in separating said front coupon strip from said bag portion.

6. The bag of claim 1 wherein said rear coupon strip further comprises perforations to assist in separating said rear coupon strip from said bag portion.

* * * * *